US005085786A

United States Patent [19]

Alm et al.

[11] Patent Number: 5,085,786

[45] Date of Patent: Feb. 4, 1992

[54] AQUEOUS FILM-FORMING FOAMABLE SOLUTION USEFUL AS FIRE EXTINGUISHING CONCENTRATE

[75] Inventors: Roger R. Alm, Lake Elmo; Richard M. Stern, Woodbury, both of Minn.

[73] Assignee: Minnesota Mining and Manufacturing Company, St. Paul, Minn.

[21] Appl. No.: 645,557

[22] Filed: Jan. 24, 1991

[51] Int. Cl.[5] ..... A62D 1/00

[52] U.S. Cl. ..... 252/8.05; 252/3; 252/307; 169/44; 169/46

[58] Field of Search ..... 252/8.05, 3, 307; 169/46, 44

[56] References Cited

U.S. PATENT DOCUMENTS

| | | | |
|---|---|---|---|
| 3,258,423 | 6/1966 | Tuve | 252/3 |
| 3,562,156 | 2/1971 | Francen | 252/8.05 |
| 3,772,195 | 11/1973 | Francen | 252/8.05 |
| 3,957,657 | 5/1976 | Chiesa | 252/3 |
| 4,042,522 | 8/1977 | Falk | 252/8.05 |
| 4,090,967 | 5/1978 | Falk | 252/3 |
| 4,350,206 | 9/1982 | Hoffmann et al. | 169/47 |
| 4,359,096 | 11/1982 | Berger | 169/44 |
| 4,420,434 | 1/1983 | Falk | 260/501.12 |
| 4,432,882 | 2/1984 | Raynolds et al. | 252/8.55 R |
| 4,472,294 | 9/1984 | Hisamoto et al. | 252/356 |
| 4,511,733 | 4/1985 | Hisamoto et al. | 560/253 |
| 4,536,298 | 8/1985 | Kamei | 252/8.05 |
| 4,795,590 | 1/1989 | Kent et al. | 252/307 |
| 4,795,590 | 1/1989 | Kent | 252/307 |

FOREIGN PATENT DOCUMENTS 1415400 11/1975 United Kingdom .

*Primary Examiner*—Robert L. Stoll
*Assistant Examiner*—N. Bhat
*Attorney, Agent, or Firm*—Gary L. Griswold; Walter N. Kirn; Eloise J. Maki

[57] ABSTRACT

An improved aqueous film-forming foamable concentrate which is particularly useful for extinguishing flammable liquid fires. The preferred formulation contains (a) fluoroaliphatic amphoteric surfactant, preferably a fluorinated aminocarboxylate having a $C_4$ to $C_{10}$ perfluoroaliphatic group, (b) fluoroaliphatic anionic surfactant, preferably a $C_4$ to $C_{10}$ perfluoroalkane suflonate, and (C) short chain ($C_6$ to $C_{10}$) alkyl ether sufate hydrocarbon surfactant. When the concentrate is diluted with fresh or sea water and aerated, an aqueous film-forming foam is produced which is useful in extinguishing flammable liquid fires such as a fuel fire. The foam quickly spreads a superior vapor-sealing film on the surface of a burning fuel. The film reforms quickly when disturbed. The improved film-forming properties results in quicker and more reliable extinguishment of flammable liquid fires.

19 Claims, No Drawings

AQUEOUS FILM-FORMING FOAMABLE SOLUTION USEFUL AS FIRE EXTINGUISHING CONCENTRATE

The present invention relates to aqueous film-forming foamable solution useful as a concentrate for extinguishing fires. In another aspect the invention relates to the use of aqueous film-forming foamable concentrates in extinguishing flammable liquid fires.

Aqueous foaming agents, in particular those called aqueous film-forming foams (AFFFs) comprising fluorochemical surfactants, have become an increasingly important means for extinguishing hydrocarbon and other flammable liquid fires. In view of the importance of fire extinguishing materials in saving of lives and in reducing property loss, there is continuing urgency to improve these materials.

Concentrated aqueous fluorochemical surfactant-containing solutions which produce an aqueous film-forming foam upon dilution (typically with 94 to 99 percent fresh or sea water) and aeration, must possess a combination of important properties to be effective in extinguishing flammable liquid fires. The concentrate formulation upon dilution must exhibit superior foaming characteristics to produce a thick foam blanket that quickly "knocks down" (rapidly extinguishes) the fire and is retained or persists for some time after extinguishment of the fire. The fluorochemical surfactants normally present in the concentrates must depress the surface tension of the aqueous solution draining from the foam to within certain ranges below the surface tension of the flammable liquid, e.g. fuel, so that a vapor-sealing film draining from the foam spreads readily over the flammable liquid. The film must have a strong tendency to reform if it is disturbed or broken, thus reducing the tendency of fires to reignite where the film has been disturbed, for example, by wind blowing over the foam. The formulations must pass stability requirements which assure that the foaming and film-forming properties are not adversely affected by prolonged storage. The formulation must also be cost effective and commercially feasible.

In years past, prior to about the mid-1960s, protein foams were the only foams used for extinguishment of hydrocarbon fuel fires. These foams were formed of hydrolyzed protein, for example, hydrolyzed keratin, albumins and globulins, and typically stabilized with ferrous sulfate to give a foaming agent useful for extinguishing such fires. However, these protein-based foams were difficult to apply to hydrocarbon fires since they required careful lay-down of a heavy blanket of foam over the fire. Any disruption in the foam resulted in flare-up of the burning fuel. Also, the protein foaming agent exhibited poor shelf life upon storage, and the foams produced therefrom would collapse when co-applied with dry powder agents due to the silicone treatment on the powder.

In the mid-1960s the U.S. Naval Research Laboratory developed the first successful aqueous film-forming foam system using fluorochemical surfactants, as described in U.S. Pat. No. 3,258,423 (Tuve et al.). These foams showed much improvement in extinguishing hydrocarbon fires, since they functioned usefully even after the air- containing liquid bubbles had collapsed. These foams released a thin aqueous film which spread on the fuel surface and was impervious to fuel vapors, thus preventing reignition of fuel.

In said U.S. Pat. No. 3,258,423, fluorochemical aqueous foaming agents, which are derivatives of perfluorocarboxylic and perfluorosulfonic acids, are disclosed having the general formula $R_fCO_2H$ and $R_5SO_3H$ respectively, where for example $R_f$ in the carboxylic acid is a perfluoroalkyl chain of seven carbon atoms, $C_7F_{15}$—, and in the sulfonic acid the $R_f$ is a perfluoroalkyl chain of eight carbon atoms, $C_8F_{17}$—.

In U.S. Pat. No. 4,536,298 (Kamei) a fluorinated aminocarboxylate is disclosed having the formula:

$$C_6F_{13}SO_2\underset{\underset{CH_2CH_2COONa}{|}}{N}(CH_2)_3N(CH_3)_2$$

This compound and related compounds are described in this reference as useful surface active agents for fire extinguishing agents. A related compound having the formula $C_6F_{13}SO_2N(CH_2COOH)C_3H_6N(CH_3)_2$ is disclosed in U.S. Pat. No. 4,795,590 (Kent et al.). This latter compound normally requires use of chloroacetic acid during synthesis. The by-product chloride resulting from this procedure tends to cause localized corrosion and pitting of stainless steel used in fire-fighting equipment.

In U.K. Patent Specification 1,415,400 are disclosed representative fluoroaliphatic amphoteric and fluoroaliphatic anionic surfactants for use in fire-fighting compositions.

In U.S. Pat. No. 4,795,590 (Kent et al.) formulations for producing a gelled air foam are disclosed together with representative fluoroaliphatic surfactants. These fluoroaliphatic surfactants can have the general formula $(R_f)_n(Q)_mZ$ where $R_f$ is a fluoroaliphatic radical, Z is a water-solubilizing polar group, and Q is a suitable linking group. One anionic fluoroaliphatic surfactant of the foregoing class is $C_8F_{17}SO_3K$ (column 11, line 59). This latter species is also listed, inter alia, in U.S. Pat. No. 4,359,096 (Berger).

A fluorine-free hydrocarbon surfactant having the formula $C_{12}H_{25}O(C_2H_4O)_4C_2H_4OSO_3NH_4$ is also disclosed, inter alia, in said U.S. Pat. No. 4,795,590, col. 13, 1. 3. In U.S. Pat. No. 3,562,156 (Francen), the class of fluoroaliphatic surfactants having general formula $(R_f)_n(Q)_mZ$ is also described together with specific formulations utilizing such compounds to produce useful fire extinguishing foams. This reference also describes the use of a film-promoting, fluorine-free surfactant in formulations containing the fluoroaliphatic surfactant. Specific fluorine-free surfactants listed are, for example, polyoxyethylene ether alcohol, dioctyl sodium sulfosuccinate, and ammonium alkyl phenoxy polyoxyethylene sulfate.

In U.S. Pat. No. 3,772,195 (Francen) a list of hydrocarbon (fluorine-free) surfactants for fluorochemical fire-extinguishing, foam-producing concentrates is disclosed. An alkyl ether sulfate surfactant having the formula $C_{12}H_{25}(OC_2H_4)_nOSO_3NH_4$, sold under the trade name SIPON EAY surfactant, is disclosed (Table 6). This compound is also disclosed in U.S. Pat. No. 3,957,657 (Chiesa).

In one aspect the present invention provides an aqueous film-forming foamable solution useful as a concentrate for producing a film-forming foam. The solution, concentrate or formulation of the invention comprises an aqueous solution of:

a) fluoroaliphatic amphoteric surfactant, preferably a fluorinated aminocarboxylate;

b) fluoroaliphatic anionic surfactant, preferably a perfluoroalkane sulfonate, and c) alkyl ether sulfate surfactant having a $C_6$ to $C_{10}$ alkyl chain, said concentrate, upon dilution with water and aeration, producing a film-forming foam which is applied to a body of flammable liquid such as a spill or pool which is burning or subject to ignition, said foam extinguishing said burning liquid or preventing ignition. The concentrate has excellent foaming properties upon dilution and aeration and imparts film-forming characteristics to the foam produced, i.e. generates a thicker, more durable film that spreads on the surface of the flammable liquid or fuel. This results in quicker fire knockdown and extinguishment times. The formulation also exhibits excellent storage stability. Thus, the formulation provides more reliable and effective extinguishment of flammable liquid fires.

The formulations of this invention are aqueous solution concentrates which when diluted with water and aerated produce a low density air-foam which quickly spreads on the surface of a body of hydrocarbon fuel, or other flammable liquid forming a blanket over the fuel or liquid. As aqueous solution drains from the foam, a continuous vapor-sealing, vapor-suppressing film is formed which reforms whenever broken or disturbed. The concentrate may be conveniently diluted with fresh, sea, or brackish water.

Because the foam produced upon dilution and aeration of the aqueous concentrate of this invention exhibits excellent foaming and film-forming characteristics, the foam is capable of extinguishing flammable liquid fires, such as hydrocarbon or alcohol fuel fires, more rapidly than foams employing fluoroaliphatic amphoteric and/or fluoroaliphatic anionic surfactants with typically used anionic hydrocarbon surfactants such as sodium octyl or lauryl sulfate and non-ionic surfactants such as ethoxylated octylphenol The foam produced from the concentrate of the present invention extinguishes more of the flammable liquid fire per unit time (flame knockdown property) than foams produced from the conventional concentrates.

In an actual practice of this invention, as water under pressure passes through a fire hose, typically 3 percent by volume of the fluorochemical concentrate solution is inducted into the hose line by venturi effect to form a premixture (or "premix") of the concentrate diluted with water; said premix becomes aerated to produce a foam by use of an air-aspirating nozzle located at the outlet end of the hose. Additional description of equipment which can be used to produce and apply the aqueous air-foam of the invention is recited in the National Fire Protection Association (NFPA) Bulletin 11-1988 Standard of the National Fire Protection Assoc., Inc. The foam is applied to a body of burning fuel or other flammable liquid. As the foam (on the surface of the flammable liquid) drains, a film is formed which, if disturbed or broken, tends to reform to seal off hot vapor emanating from the flammable liquid, thus extinguishing the fire. Additionally, the concentrate formulation of the invention is highly storage stable and easily passes the U.S. Government specification (MIL-F-24385C) that requires foaming and film-forming properties of concentrates not be adversely affected if the concentrate and its fresh and sea water premixes (i.e.,-concentrate diluted with water) are stored at 65° C. for a period of 10 days, simulating room temperature storage for a period of about 10 years. This stability requirement is not easily achieved with aqueous film-forming foam (AFFF) concentrates employing fluorinated amino carboxylates. The use of conventional sea water compatibilizing hydrocarbon surfactants, such as alkyl sulfates and ethylene oxide-based nonionics, produces an AFFF product with poor premix foamability after long term aging.

A preferred Concentrate B, having the aforementioned properties, is shown in Table I. The Concentrate B is a solution composition comprising fluoroaliphatic surfactants, and an alkyl ether sulfate hydrocarbon surfactant. In Concentrate B, the fluoroaliphatic film-forming foam surfactants advantageously include both a fluoroaliphatic amphoteric surfactant and a fluoroaliphatic anionic surfactant.

The fluoroaliphatic amphoteric surfactant for the concentrate of the invention can be a fluoroaliphatic compound containing at least one non-polar, fluoroaliphatic group, and polar, water-solubilizing moieties comprising at least one cationic (or cationogenic) group and at least one anionic (or anionogenic) group.

A class of these fluoroaliphatic amphoteric surfactants used in this invention has the general formula (A), $$R_fX\underset{\underset{R^2N^+(R)_3}{|}}{N}R^1A^- \qquad (A)$$

where $R_f$ is a fluoroaliphatic group; X is selected from the group consisting of CO and $SO_2$; $R^1$ and $R^2$ represent divalent organic radicals, preferably free from non-aromatic unsaturation, such as, alkylene (e.g. ethylene or propylene), alkyleneoxy, arylene, aralkylene or alkarylene, of 1 to 12 carbon atoms, preferably 2 to 6 carbon atoms, wherein alkylene, alkyleneoxy, arylene, aralkylene or alkarylene also includes substituted groups if their presence do not interfere with the desirable film-forming and foaming properties of the formulation. Each R group in formula (A) represents like or different groups, which are independently selected from the group consisting of hydrogen, aryl (aryl includes also substituted aryl groups e.g. tolyl, chlorophenyl, hydroxyphenyl), and alkyl groups, said aryl and alkyl groups of 1 to about 18 carbon atoms, which can be unsubstituted or substituted, e.g., with aryl groups e.g., benzyl, or water solubilizing groups, e.g. hydroxyl, or polyoxyalkylene, and any two of the R groups taken together with the N atom to which they are attached can form a heterocyclic ring, e.g., a piperidyl or morpholinyl ring; it is preferred that at least two of the three R groups in formula (A) are lower alkyl groups with 1 to 6 carbon atoms such as methyl or ethyl. $A^-$ is an anion derived or selected from the group consisting of $-CO_2^-$, $-SO_2^-$, $-SO_3^-$, $-OSO_3^-$, and $-OP(OH)O^-$.

The fluoroaliphatic radical, $R_f$, in the above general formula (A) (and in this specification) is a fluorinated, stable, inert, preferably saturated, non-polar, monovalent aliphatic radical. It can be straight chain, branched chain, or cyclic, or combinations thereof. It can contain catenary heteroatoms, bonded only to carbon atoms, such as oxygen, divalent or hexavalent sulfur, or nitrogen. $R_f$ is preferably a fully fluorinated radical, but hydrogen or chlorine atoms can be present as substituents provided that not more than one atom of either is present for every two carbon atoms. The $R_f$ radical has at least 3 carbon atoms, preferably 3 to 20 carbon atoms and most preferably about 4 to 10 carbon atoms, and preferably contains about 40% to about 78% fluorine by weight, more preferably about 50% to about 78% fluorine by weight. The terminal portion of the $R_f$ radical is a perfluorinated moiety which will preferably contain at least 7 fluorine atoms, e.g., $CF_3CF_2CF_2$—, $(CF_3)_2CF$—, $F_5SCF_2$—, or the like. The preferred $R_f$ radicals are fully or substantially fluorinated and are preferably those perfluorinated aliphatic radicals of the formula $C_nF_{2n+1}$—.

A preferred sub-class of fluoroaliphatic amphoteric surfactants of general formula (A) above is a fluoroaliphatic carboxamide or, most preferably a fluoroaliphatic sulfonamide having (both) a carboxy group-containing moiety and an amino group-containing moiety (as the anionic and cationic groups, respectively) attached to the N atom of the carboxamido or sulfonamido moiety. This preferred class can be represented by the general formula (B), $$\begin{array}{l} R_fXNR^1COO^- \\ \quad\;\; | \\ \quad\;\; R^2N^+(R)_2H \end{array} \qquad (B)$$

where $R_f$ is a fluoroaliphatic radical as described above for formula (A), X is CO or $SO_2$ and is preferably $SO_2$, and $R^1$, $R^2$ and R are as defined above for formula (A). Each R preferably represents like or different groups selected from the group consisting of hydrogen, and alkyl groups of 1 to 12 carbon atoms; preferably each R is a lower alkyl group of 1 to 6 carbon atoms such as methyl or ethyl. In the above formulas (A) and (B) the groups R, $R^1$ and $R^2$ may also include any substituent groups thereon if their presence do not interfere with the desirable film-forming and foaming properties of the formulation of the invention.

A preferred sub-class of fluoroaliphatic amphoteric surfactants of general formula (B), shown in its zwitterionic form, is a fluoroaliphatic sulfonamido aminocarboxylate compound having the formula (C), $$\begin{array}{l} R_fSO_2NC_2H_4CO_2^- \\ \quad\;\; | \\ \quad\;\; C_3H_6N^+(CH_3)_2H \end{array} \qquad (C)$$

where $R_f$ is a fluoroaliphatic radical as defined above and preferably has the formula $C_nF_{2n+1}$—, where n is 4 to 10, preferably 6 to 8.

The non-ionized form of compound (C) above, has the formula (D) below $$\begin{array}{l} R_fSO_2NC_2H_4CO_2H \\ \quad\;\; | \\ \quad\;\; C_3H_6N(CH_3)_2 \end{array} \qquad (D)$$

It is understood that formula (C) is the structure of the aminocarboxylate in an essentially neutral medium, e.g. of pH 6 to 8; the structure of this compound in a strongly basic medium, e.g. sodium hydroxide solution is $R_fSO_2N(C_2H_4CO_2Na)C_3H_6N(CH_3)_2$; and the structure of the compound in a strongly acidic medium, e.g. in HCl solution, is $R_fSO_2N(C_2H_4CO_2H)C_3H_6N^+(CH_3)_2H\ Cl^-$.

Representative fluoroaliphatic amphoteric surfactants for the formulations of the invention are:

$C_6F_{13}SO_2N[CH_2CH(OH)CH_2SO_3^-]C_3H_6N^+(CH_3)_2C_2H_4OH$ $C_6F_{13}SO_2N(C_3H_6SO_3^-)C_3H_6N^+(CH_3)_2C_2H_4OH$ $C_7F_{15}CONHC_3H_6N^+(CH_3)_2C_2H_4COO^-$ $C_6F_{13}C_2H_4SO_2N(CH_3)C_2N_4N^+(CH_3)_2C_2H_4COO^-$ $C_6F_{13}SO_2NHC_3H_6N^+(CH_3)_2CH_2CH_2COO^-$ $C_8F_{17}SO_2NHC_3H_6N(CH_3)C_3H_6SO_3Na$ $C_8F_{17}SO_2NHC_3H_6N(C_2H_4OH)C_3H_6SO_3Na$ $C_7F_{15}CONHC_3H_6N(CH_3)C_3H_6SO_3Na$ $C_6F_{13}SO_2N(C_2N_5)C_3H_6NHCH_2HC(OH)(CH_2SO_3Na$ $C_4F_9SO_2NHC_3H_6N^+(CH_3)_2CH_2COO^-$ $C_6F_{13}C_2H_4SC_2H_4N^+(CH_3)_2CH_2COO^-$ $C_6F_{13}SO_2NHC_3H_6N^+(CH_3)_2C_3H_6SO_3^-$ $C_6F_{13}SO_2N(CH_2COO^-)C_3H_6N^+(CH_3)_3$ $C_6F_{13}SO_2N(C_2H_4COONa)C_3H_6N^+(CH_3)_2C_2H_4COO^-$ $C_8F_{17}CH_2CH(COO^-)N^+(CH_3)_3$ $(CF_3)_2CFOC_3F_6CONHC_2H_4N^+(CH_3)_2C_2H_4COO^-$ $$\begin{array}{l} \quad\quad\;\; C_2H_4COOH \\ \quad\quad\;\; | \\ C_6F_{13}SO_2N \\ \quad\quad\;\; | \\ \quad\quad\;\; C_3H_6N^+(CH_3)_2C_2H_4COO^- \end{array}$$

A representative subclass of the fluoroaliphatic amphoteric surfactants are amphoteric fluorinated aminocarboxylates for the formulations of the invention:

$$\begin{array}{l} \quad\quad\;\; CH_2COOH \\ \quad\quad\;\; | \\ C_8F_{17}SO_2NC_3H_6N^+(CH_3)_2H \end{array}$$

$$\begin{array}{l} \quad\quad\;\; C_2H_4COO^- \\ \quad\quad\;\; | \\ C_8F_{17}SO_2N \\ \quad\quad\;\; | \\ \quad\quad\;\; C_3H_6N^+(C_2H_5)_2H \end{array}$$

$$\begin{array}{l} \quad\quad\;\; C_2H_4COO^- \\ \quad\quad\;\; | \\ C_6F_{13}SO_2N \qquad\quad N^+(CH_3)_2H \end{array}$$

$$\begin{array}{l} \quad\quad\quad\quad C_2H_4COO^- \\ \quad\quad\quad\quad | \\ C_8F_{17}C_2H_4SO_2NC_3H_6N^+(CH_3)_2H \end{array}$$

$C_{10}F_{19}OC_6H_4SO_2N(CH_2COO^-)C_3H_6N^+(CH_3)_2H$ $$\begin{array}{l} \quad\quad\quad\quad\quad\quad\quad\quad\quad\quad\quad\quad CH_2COO^- \\ \quad\quad\quad\quad\quad\quad\quad\quad\quad\quad\quad\quad | \\ C_3F_7OCF(CF_3)CF_2OCF(CF_3)CF_2CONC_3H_6N^+(CH_3)_2H \end{array}$$

$$\begin{array}{l} \quad\quad\;\; CH_2COO^- \\ \quad\quad\;\; | \\ C_7F_{15}CONC_3H_6N^+(CH_3)_2H \end{array}$$

$$\begin{array}{l} \quad\quad\;\; C_2H_4COO^- \\ \quad\quad\;\; | \\ C_6F_{13}SO_2N \\ \quad\quad\;\; | \\ \quad\quad\;\; C_3H_6N^+(CH_3)_2H \end{array}$$

$$\begin{array}{l} \quad\quad\;\; C_2H_4COO^- \\ \quad\quad\;\; | \\ C_8F_{17}SO_2N \\ \quad\quad\;\; | \\ \quad\quad\;\; C_3H_6N^+(C_4H_9)_2H \end{array}$$

$C_6F_{13}SO_2N(H)C_3H_6N^+(CH_3)_2C_2H_4COO^-$

The fluoroaliphatic anionic surfactant useful for the concentrate of this invention is a fluoroaliphatic compound containing at least one fluoroaliphatic radical, $R_f$, and an anionic (or anionogenic) group. The anionic group in the form of an acid preferably has an ionization constant greater than $1\times10^{-5}$ in aqueous solution at 25° C. The anionic group can be $CO_2H$, $CO_2M$, $SO_2M$, $SO_3H$, $SO_3M$, $OSO_3M$, $OP(OH)_2$, $OP(OH)OM$ or $OP(OM)_2$, where M, if present, may typically be sodium or potassium, but can be any counterion, e.g. a metal ion such as $Na^+$, $K^+$, $Li^+$, $Ca^{++}$, $Mg^{++}$or any ammonium ion $N^+(R^3)_4$, where each $R^3$ may be independently selected from the group consisting of hydrogen, alkyl (e.g. methyl), hydroxyalkyl (e.g. hydroxyethyl), aryl (e.g. phenyl), aralkyl (e.g. benzyl) or alkaryl group (e.g., tolyl). It is preferred that there be only one such anionic group and no other ionizable groups in the molecule. Preferably the anionic group is $SO_3M$. The anionic surfactant preferably contains 30 to 65 percent by weight of fluorine (located in the fluoroaliphatic group) to provide the proper solubility and surface tension characteristics. Preferably the structure of the fluoroaliphatic anionic surfactant is $$R_fSO_3M \quad \text{(E)}$$

where $R_f$ is a fluoroaliphatic radical as defined above, and preferably has the formula $C_nF_{2n+1}-$, where n is 4 to 10, preferably 6 to 8, and M is defined as above.

Representative anionic fluoroaliphatic surfactants for the formulations of the invention are:

$C_8F_{17}SO_3K$
$C_8F_{17}SO_2NHCH_2C_6H_4SO_3Na$
$C_8F_{17}SO_2NHC_6H_4SO_3H$
$C_8F_{17}C_2H_4SC_2H_4CONHC(CH_3)_2CH_2SO_3Na$
$C_8F_{17}SO_2N(C_2H_5)C_2H_4OP(O)(OH)_2$
$(CF_3)_2CF(CF_2)_6COO^-\ H_3N^+C_2H_5$
$C_8F_{17}SO_2N(C_2H_5)CH_2CO_2K$
$C_{10}F_{19}OC_6H_4SO_3Na$
$(CF_3)_2CF(CF_2)_4CONHC_2H_4SO_3Na$
$C_7F_{15}COO^-\ H_3N^+CH_2COOH$
$C_8F_{17}C_2H_4OSO_3Na$
$C_{10}F_{21}SO_3NH_4$
$C_7F_{15}COONH_4$
$(C_6F_{13}C_2H_4S)_2C(CH_3)C_2H_4COOH$
$C_8F_{17}C_2H_4SO_2CH_2COONa$
$C_6F_{13}C_2H_4COONa$

The fluoroaliphatic surfactant compounds employed in the compositions of this invention advantageously should have a balance of properties between the nonpolar fluoroaliphatic radical(s), the polar water soluble group(s), e.g., anionic or cationic groups present, and any organic linking groups in the surfactant compound, so as to provide a solubility in water at 25° C. of at least 0.01 percent by weight, preferably at least about 0.05 percent by weight. If either amphoteric or anionic fluoroaliphatic surfactant is too soluble in the flammable liquid, it may be extracted too rapidly from the aqueous film to provide sufficiently durable coverage. In general, this requires at least about 20 percent by weight of fluorine in the fluoroaliphatic radical portion of the surfactant. In order to function most effectively as a film-spreading agent, each fluoroaliphatic surfactant must be sufficiently surface active to provide a surface tension of less than about 28 dynes/cm, preferably less than 23 dynes/cm, in aqueous solution at a concentration of about 0.05 to 0.10 percent by weight or less.

The preferred fluoroaliphatic amphoteric surfactant, as shown in Table I, is a fluorinated aminocarboxylate, having the formula:

$$\begin{array}{l} \quad\quad C_2H_4COO^- \\ \quad\quad\quad | \\ C_6F_{13}SO_2NC_3H_6N^+(CH_3)_2H \end{array} \quad \text{(I)}$$

(A fluorinated aminocarboxylate which is the sodium salt of the above referenced compound is referenced in U.S. Pat. No. 4,536,298 at Col. 3, line 62–64.)

A preferred fluorocarbon anionic surfactant is a perfluoroalkane sulfonate, having a $C_4$ to $C_{10}$ alkyl chain. The most preferred perfluoroalkane sulfonate is a perfluorooctane sulfonate having the formula:

$$C_8F_{17}SO_3M \quad \text{(II)}$$

where M can be any counterion as defined earlier, and is preferably sodium or potassium.

The alkyl ether sulfate hydrocarbon surfactant employed in Concentrates B, C, D and F of Table I has the formula:

$$C_nH_{2n+1}O(C_2H_4O)_mSO_3M \quad \text{(III)}$$

where n is an integer of 6 to 10, preferably 8 to 10, and m has a value of 1 to 10, preferably between 2 to 5. M can be any counterion, as defined earlier and is preferably sodium or potassium. A preferred alkyl ether sulfate, having the above formula wherein n is an integer of 8 to 10 and m has an average value of about 2, is that surfactant sold under the tradename WITCOLATE TM 7093 surfactant. Concentrates B and C also includes an alkyl sulfate in addition to the alkyl ether sulfate; the preferred alkyl sulfate for use in these formulations is sodium n-octyl sulfate, sold under the tradename SIPEX TM OLS.

It is not known with certainty why marked improvement in flame "knockdown" is achieved when employing the preferred formulations of the present invention. However, the applicants believe that the inclusion of a relatively short chain i.e., $C_6$ to $C_{10}$ alkyl ether sulfate, is a critical component in the compositions or concentrates of this invention, particularly in a formulation containing a fluorinated aminocarboxylate and a perfluoroalkane sulfonate, preferably a perfluoroctane sulfonate. Specifically, it is believed that the incorporation of a $C_6$ to $C_{10}$ alkyl ether sulfate in the foam concentrate achieves optimum fire extinguishing performance by optimizing both foam and film properties, as well as to provide excellent storage stability to the concentrate and its fresh water and sea water premix solutions.

In order for a film from an aqueous film-forming foam to most effectively spread on a hydrocarbon fuel, it has a positive spreading coefficient. The spreading coefficient, SC, as in U.S. Dept. of Defense Military Specification MIL-F-24385D, is defined as follows:

$$SC = \tau(\text{fuel/air}) - [\tau(\text{premix/air}) + \phi(\text{premix/fuel})]$$

where:

SC = spreading coefficient, dyne/cm
$\tau$(fuel/air) = surface tension between the fuel and air, dyne/cm
$\tau$(premix/air) = surface tension between the AFFF premix and air, dyne/cm
$\phi$(premix/fuel) = interfacial tension between the AFFF premix and fuel, dyne/cm Formulations of this invention utilizing a combination of a fluoroaliphatic amphoteric and anionic surfactant together with a short chain ($C_6$ to $C_{10}$) alkyl ether sulfate give a desirable positive spreading coefficient, i.e. above 0.1. At the same time, the interfacial tension between the vapor-sealing film and the fuel is not reduced to such a low value as to cause emulsification or undesirable thinning of the film, thus achieving superior film properties, i.e. a thicker, more durable film. Inclusion of an alkyl ether sulfate having a longer alkyl chain, e.g., $C_{12}$ or higher, can also produce a positive spreading coefficient, but the interfacial tension produced between the film and the fuel is undesirably low, especially in sea water premixes, leading to formation of a very thin aqueous film which is easily emulsified by the fuel, especially in formulations containing the fluorinated aminocarboxylate and perfluoroalkane sulfonate components described herein. Additionally, these longer chain alkyl ether sulfates frequently interfere with the surface tension function of the fluorochemical surfactants, causing a significant rise in measured surface tension.

Other types of hydrocarbon surfactants commonly used in aqueous film-forming foam concentrates, such as alkyl sulfates and ethylene oxide-based nonionics, are not as desirable in formulations containing fluoroaliphatic amphoteric and anionic surfactant blends, especially blends of fluorinated aminocarboxylates and perfluoroalkane sulfonates. Alkyl sulfates, such as sodium octyl or decyl sulfate, are good foam boosters in fresh water but are not as effective in saline water. Inclusion of a nonionic surfactant, such as a ethoxylated alkylphenol, commonly used to improve sea water compatibility and resultant foamability, produces a foam concentrate showing surprisingly poor foam expansion after aging, especially when aged as a premix solution (10 days at 65° C.). Other short chain hydrocarbon surfactants which are known in the art of aqueous film-forming foams, such as $C_8$–$C_{10}$ chain length betaines, imidazolines and amine oxides, either do not perform well as foaming agents or compatibilizers in sea water or do not provide superior film properties when used with the fluorochemical surfactant classes of this invention. The presence of a short chain ($C_6$–$C_{10}$) alkyl ether sulfate in the foam concentrate of this invention containing a fluoroaliphatic amphoteric surfactant and a fluoroaliphatic anionic surfactant, results in a formulation exhibiting improved fire-fighting performance by boosting both foaming and film-forming properties as well as by contributing to excellent shelf life.

An additional advantage of the short chain ($C_6$–$C_{10}$) alkyl ether sulfate over conventionally used hydrocarbon surfactants (such as sodium octyl sulfate, sodium lauryl sulfate or an ethoxylated alkylphenol) is that the short chain alkyl ether sulfate allows use of fluorinated aminocarboxylate at either 100% purity or even less than 100% purity, typically as low as 50 to 80% purity in the preferred formulations. For example, the fluorinated aminocarboxylate, $C_6F_{13}SO_2N(C_2H_4COO^-)C_3H_6N^+(CH_3)_2H$, used in the examples of this invention can have a purity of less than 90%, more typically as low as 70 to 80%, when a $C_6$ to $C_{10}$ alkyl ether sulfate surfactant is employed. If only conventionally used hydrocarbon surfactants such as sodium octyl sulfate, sodium lauryl sulfate or an ethoxylated alkylphenol are used in place of the $C_6$–$C_{10}$ alkyl ether sulfate in the fluorinated aminocarboxylate formulations, the purity of fluorinated aminocarboxylate should be at least 90% to formulate a workable concentrate, which is not practical from a commercial standpoint.

Typical ranges of concentrations of the fluoroaliphatic amphoteric surfactant, fluoroaliphatic anionic surfactant and the alkyl ether sulfate in the formulations of the invention are shown in the following table. The surfactant concentrations will vary depending upon the extent of dilution of the concentrate with water to make a premix solution (from which the aqueous film-forming foam is made). The table below gives typical ranges of concentration for these surfactants for a "3% concentrate" (to be diluted with 97 percent water), a "6% concentrate" (to be diluted with 94 percent water) and the final premix solutions obtained by said dilution of either concentrate.

| Surfactant | Surfactant Concentration Ranges (Percent by Weight) 3% Concentrate | 6% Concentrate | Final Premix Solution |
|---|---|---|---|
| Fluoroaliphatic amphoteric surfactant (preferably a fluorinated aminocarboxylate) | 2–5 | 1–2.5 | 0.06–0.15 |
| Fluoroaliphatic anionic surfactant (preferably potassium perfluorooctane sulfonate) | 1–3 | 0.5–1.5 | 0.03–0.09 |
| Alkyl ($C_6$–$C_{10}$) ether sulfate | 1–10 | 0.5–5 | 0.03–0.30 |

The concentrates of the invention preferably include optional components, for example, water soluble solvents to facilitate solubilization of the fluoroaliphatic surfactants and the alkyl ether sulfate surfactant. The solvents also may act as foam stabilizers and freeze protection agents. These solvents include ethylene glycol, diethylene glycol, glycerol, ethyl Cellosolve TM, butyl Carbitol TM, and hexylene glycol. Additional components, such as polymeric stabilizers and thickeners, can be incorporated into the concentrates of the invention to enhance the foam stability property of the foam produced from aeration of the aqueous solution of the concentrate. Examples of polymeric stabilizers and thickeners are partially hydrolyzed protein, starches, polyvinyl resins, e.g. polyvinyl alcohol, polyacrylamides, carboxyvinyl polymers, and poly(oxyethylene)glycol. In particular, polysaccharide resins, such as xanthan gum, can be incorporated as foam stabilizers in concentrates of this invention where such concentrates will be used on polar solvent fires such as alcohols, ketones and ethers (see U.S. Pat. Nos. 4,060,132 (Chiesa) and 4,060,489 (Chiesa). The concentrates of the invention advantageously include a buffer to regulate pH, for example, tris(2-hydroxyethyl) amine or sodium acetate, and a corrosion inhibitor, for example, toluoltriazole or sodium nitrite. Also, addition of a water-soluble electrolyte such as magnesium sulphate to an aqueous surfactant solution can improve the film-spreading characteristics of the aqueous film-forming foams.

The total amount of solids attributable to said optional components will be such that the aqueous solution is still foamable and the density of the foam prepared therefrom is less than 1 g/cc. Generally, the amount of solids attributable to said optional components will be less than about 40 weight percent, preferably less than about 30 weight percent, of the foamable aqueous solution.

The examples which follow are included to illustrate the features of this invention. The concentrates used in the examples are given below in Table I. Concentrates B, C, D and F are preferred concentrations of the invention and A, E and G are comparative concentrates of the inventions. Components are all expressed in percent by weight of the active solids present in the concentrate. The concentrates were prepared by simply mixing the fluoroaliphatic amphoteric surfactant, fluoraliphatic anionic surfactant, and alkyl ether sulfate and the additional components shown in Table I. Each mixture was prepared at ambient conditions using a conventional magnetic stirrer for a period of about 1 hour or until a homogeneous solution was obtained. The pH of each concentrate was adjusted to 8.0 with aqueous NaOH or $H_2SC_4$ solutions, as required. Prior to evaluation, all concentrates were mixed for use at 3.0% by volume in either fresh or sea water.

TABLE I

AFFF CONCENTRATES

| Components | PERCENT COMPONENT IN CONCENTRATES Concentrate: A* | B | C | D | E* | F | G* |
|---|---|---|---|---|---|---|---|
| Fluorochemical Surfactants | | | | | | | |
| $C_6F_{13}SO_2N(C_2H_4COO^-)C_3H_6N^+(CH_3)_2H$[1] (I) | — | 2.75 | 2.50 | 2.00 | 2.56 | 2.00 | 2.00 |
| $C_6F_{13}SO_2N(C_3H_6SO_3^-)C_3H_6N^+(CH_3)_2C_2H_4OH$[2] | 2.56 | — | — | — | — | — | — |
| $C_8F_{17}SO_3K$[3] | 1.84 | 1.00 | 1.25 | 1.00 | 1.84 | 1.00 | 1.00 |
| Hydrocarbon Surfactants | | | | | | | |
| $C_8H_{17}(OC_2H_4)_2OSO_3Na$ | — | 0.80[4] | 0.40[4] | 5.40[5] | — | 4.50[6] | — |
| $C_{10}H_{21}(OC_2H_4)_2OSO_3Na$ | — | 1.20[4] | 0.60[4] | 0.60[5] | — | 1.50[6] | — |
| $C_{12}H_{25}(OC_2H_4)_2OSO_3Na$[7] | — | — | — | — | — | — | 6.00 |
| $C_8H_{17}OSO_3Na$[8] | 3.10 | 3.00 | 5.00 | — | 3.10 | — | — |
| $C_{12}H_{25}OSO_3Na$[9] | 0.12 | — | — | — | 0.12 | — | — |
| $C_8H_{17}C_6H_4(OC_2H_4)_{30}OH$[10] | 2.10 | — | — | — | 2.10 | — | — |
| Buffer and Corrosion Inhibitor | | | | | | | |
| Tris (2-hydroxyethyl)amine | — | 1.00 | — | — | — | 1.00 | 1.00 |
| Toluoltriazole | 0.05 | 0.05 | 0.05 | — | — | — | — |
| Solvents | | | | | | | |
| Butyl Carbitol TM | 30.00 | 20.00 | 20.00 | 20.00 | 30.00 | 20.00 | 20.00 |
| Water | 60.23 | 70.70 | 70.70 | 71.00 | 60.23 | 70.00 | 70.00 |

Footnotes for Table I:
*Comparative concentrates
[1]Contains approximately 25% of by-products believed to be $C_6F_{13}SO_2N(H)C_3H_6N^+(CH_3)_2C_2H_4COO^-$ and $C_6F_{13}SO_2N(C_2H_4COOH)C_3H_6N^+(CH_3)_2C_2H_4COO^-$.
[2]Contains approximately 50% of by-product believed to be $C_6F_{13}SO_2N(C_3H_6SO_3^-)C_3H_6N^+(CH_3)_2H$.
[3]Available from 3M Company.
[4]From Witcolate 7093 (Witco Corp.) containing 40% $C_8$ and 60% $C_{10}$ alkyl ether sulfates.
[5]From Witcolate 7093 (see 4. above) and Alfonic 8-40 Ether Sulfate (Vista Chemical Co.) containing 100% $C_8$ alkyl ether sulfate.
[6]From Alfonic 810-40 Ether Sulfate (Vista Chemical Co.) containing 40% $C_8$ and 60% $C_{10}$ alkyl ether sulfates and Alfonic 8-40 Ether Sulfate (see 5. above).
[7]From Witcolate ES-2 (Witco Corp.), containing 100% $C_{12}$ alkyl ether sulfate.
[8]From Sipex OLS (Alcolac Corp.), containing 100% $C_8$ alkyl sulfate.
[9]From Duponol ME (DuPont Corp.), containing 100% $C_{12}$ alkyl sulfate.
[10]From Triton X-305 (Rohm and Haas Co.), containing 100% octylphenol ethoxylate.

EXAMPLE 1

Fire tests were conducted to demonstrate the improved performance of Concentrate B, which contained a blend of a fluorinated aminocarboxylate, a perfluorooctane sulfonate, and a short chain ($C_8$–$C_{10}$) alkyl ether sulfate of the invention, over a state-of-the-art foam formulation, Concentrate A (see Table I). This comparative Concentrate A contained a conventional widely-used fluorochemical amphoteric surfactant, (fluorinated sulfobetaine) i.e., $C_6F_{13}SO_2N(C_3H_6SO_3^-)C_3H_6N^+(CH_3)_2C_2H_4OH$, instead of the preferred fluorinated aminocarboxylate surfactant (I); the fluorochemical anionic surfactant, namely potassium perfluorooctane sulfonate, was kept the same (although at a lower level). Additionally, conventionally used hydrocarbon surfactants, namely sodium n-octyl and lauryl sulfates and a highly ethoxylated alkylphenol, were present in the comparative formulation.

The fire test procedure used in the following examples is outlined in the U.S. Department of Defense Military Specification No. MIL-F-24385 Revision C, Section 4.7.13.2, and is required for quality control of each lot of foam concentrate manufactured to meet this stringent specification. According to this procedure, 3.0 gallons of a 3.0% premix solution of the test concentrate is made in synthetic sea water (made in accordance with ASTM D1141) and is poured into a tank (having an attached hose and foam nozzle), which is then pressurized. Then 15 gallons (56.9L) of aviation gasoline is placed on a water base contained in a 50 square foot (4.65 $m^2$) circular area. After the gasoline is ignited and allowed to preburn for 10 seconds, an operator aggressively attacks the fire using foam generated from the premix by passing the premix solution at a flow rate of 2.0 gal/min (7.58 L/min) through an air-aspirating nozzle. The percent extinguishment of the fire is recorded after every 10 second interval until the fire is fully extinguished, the exact time of the extinguishment being recorded. After extinguishment, the foam is continually applied until the 90 second mark, at which time the premix solution is exhausted. Within 60 seconds after extinguishment, a one foot diameter pan containing burning gasoline is placed at the center of the 50 square foot pit and the time is recorded for 25% (12.5 square feet, or 1.16 $m^2$) of the area to become reinvolved in flames (the "25% burnback time"). The specification quantifies the "knockdown" characteristics of the aqueous film-forming foam by totalling the percent extinguishment values after 10, 20, 30 and 40 seconds and defining this as the "40-second summation".

Test results following the above procedure are summarized in Table II.

TABLE II

MIL-F-24385 Rev. C Fire Test Results

| Requirements | Concentrate: A* | B | Specification Requirement |
|---|---|---|---|
| Extinguishment time (sec) | 38 | 29 | ≦50 |
| 40-Second summation | 348 | 367 | ≧320 |

TABLE II-continued

| MIL-F-24385 Rev. C Fire Test Results | | | |
|---|---|---|---|
| | Concentrate: | | Specification |
| Requirements | A* | B | Requirement |
| 25% Burnback time (sec) | >420 | >420 | ≧360 |

*Comparative concentrate

Results in Table II show that Concentrate B easily met all specification values for extinguishment time, 40-second summation and 25% burnback time. In fact, Concentrate B clearly outperformed Comparative Concentrate A in both its ability to knock down and to fully extinguish the fire, even though Concentrate B contained nearly a 15% lower fluorochemical surfactant concentration. Thus, Concentrate B, containing fluorinated aminocarboxylate, potassium perfluorooctane sulfonate and a short chain ($C_8$–$C_{10}$) alkyl ether sulfate, is a superior composition for preparation of aqueous film-forming foam for extinguishment of gasoline fires.

EXAMPLE 2

Another set of fire tests was run to demonstrate the superiority of Concentrate C (another formulation based on a fluorinated aminocarboxylate, a perfluorooctane sulfonate and a $C_8$–$C_{10}$ alkyl ether sulfate surfactant combination) over Concentrate A, the same comparative concentrate as used in Example 1. The fire tests were run in an indoor test facility, which contained a fully automated fixed nozzle spray system designed to minimize both operator and weather variables. This system employed four foam-generating nozzles located above a circular fire pan to extinguish the flammable fuel fire therein, and employed radiometers to measure radiant heat emitted during the course of fire extinguishment and burnback testing. The exact fire testing procedure is described in proposed U.S. Department of Defense Military Specification No. MIL-F-24385 Revision D, Section 4.7.14, and is run analogously to the procedure described in the aforementioned Revision C specification, with the following important differences: 1) the fire size is 28-square feet (2.60 $m^2$), 2) the fuel used is n-heptane (10 gallons or 37.9 L), 3) a 25-second summation parameter is used (summing percent extinguishment reading taken after 10, 15, 20 and 25 seconds of foam application), and 4) the burnback test is run only to 15% fire reinvolvement.

During this particular series of tests, formulations were evaluated at both full (3.0%) and half (1.5%) strength as sea water premixes. The test results obtained following the above procedure are summarized in Table III.

TABLE III

| MIL-F-24385 Rev. D Fire Test Results | | | | |
|---|---|---|---|---|
| | Concentration in Synthetic Sea Water: | | | |
| | 3.0% Solution | | 1.5% Solution | |
| | Concentrate: | | | |
| | C | A* | C | A* |
| Percent fire extinguished after: | | | | |
| 10 seconds | 88 | 65 | 74 | 45 |
| 15 seconds | 92 | 86 | 90 | 64 |
| 20 seconds | 95 | 93 | 92 | 85 |
| 25 seconds | 98 | 94 | 94 | 92 |
| 25 second summation | 373 | 338 | 350 | 286 |
| Time measured for (seconds): | | | | |
| 90% Extinguishment | 13 | 17 | 16 | 24 |
| Total extinguishment | 43 | 43 | 47 | 50 |

TABLE III-continued

| MIL-F-24385 Rev. D Fire Test Results | | | | |
|---|---|---|---|---|
| | Concentration in Synthetic Sea Water: | | | |
| | 3.0% Solution | | 1.5% Solution | |
| | Concentrate: | | | |
| | C | A* | C | A* |
| 15% Burnback time (seconds) | 600 | 718 | 643 | 504 |

*Comparative

According to percent extinguishment vs. time data recorded, Concentrate C clearly outperformed the Comparative Concentrate A at both 3.0% and 1.5% premix concentrations; this is expecially apparent upon examining percent fire extinguishments after only 10 seconds (88% vs. 65% for 3.0% premixes and 74% vs. 45% for 1.5% premixes, respectively). The 25-second summation for Concentrate C at 3.0% premix concentration was 373 (out of a perfect 400), which was far superior to the 338 value calculated for the Comparative Concentrate A. In fact, the 25-second summation for Concentrate C run at half strength (1.5% premix) was actually higher than the summation for Concentrate A run at full strength (3.0% premix). Though the 15% burnback values run at full strength slightly favored Concentrate A, the values at half strength greatly favored Concentrate C.

Thus, Concentrate C of this invention clearly outperforms Comparative Concentrate A, a widely used state-of-the art foam concentrate, in rapid knockdown and extinguishment of a specification n-heptane fire.

EXAMPLE 3

This example illustrates the improvement in product stability achieved when aqueous film-forming foams containing fluorinated aminocarboxylate surfactant are formulated with a short chain ($C_8$–$C_{10}$) alkyl ether sulfate surfactant rather than state-of-the-art alkyl sulfate and ethoxylated alkylphenol hydrocarbon surfactants. To demonstrate this advantage, three formulations were selected for comparison of foam expansion properties (i.e. volume of foam divided by volume of liquid used to make foam) before and after oven aging for 10 days at 65° C. (simulating storage for approximately 10 years under ambient conditions) in accordance with U.S. Department of Defense Military Specification No. MIL-F-24385 Revision C, Section 4.7.5, using the standard National Foam System 2 gal/min (7.6 L/min) nozzle. Concentrate A was the same state-of-the-art Comparative Concentrate as used in Examples 1 and 2. Concentrate E was a comparative concentrate the same as Concentrate A except that the fluorinated aminocarboxylate surfactant was directly substituted for the fluorinated sulfobetaine surfactant, keeping the state-of-the-art alkyl sulfate and ethoxylated alkylphenol surfactants the same. Concentrate D utilizes fluorinated aminocarboxylate surfactant but employs a short chain ($C_8$–$C_{10}$) alkyl ether sulfate blend in place of the alkyl sulfate/ethoxylated alkylphenol hydrocarbon surfactant blend used in Comparative Conentrate E. The foam expansion test results obtained following the above referenced Military Specification are summarized in Table IV.

TABLE IV

Foam Expansions of Premixes: Initially and After Aging for 10 Days at 65° C.

| | Concentrate: | | |
|---|---|---|---|
| | A* | E* | D |
| 3.0% Premix in fresh water: | | | |
| Initial | 8.9 | 8.7 | 8.8 |
| After aging | 8.1 | 4.6 | 8.6 |
| MIL-F-24385 Specification | ≧6.0 | ≧6.0 | ≧6.0 |
| 3.0% Premix in sea water: | | | |
| Initial | 9.1 | 8.0 | 9.1 |
| After aging | 8.1 | 6.6 | 8.6 |
| MIL-F-24385 Specification | ≧6.0 | ≧6.0 | ≧6.0 |

*Comparative

Results in Table IV show that if the fluorinated aminocarboxylate was used to directly replace the state-of-the-art fluorinated sulfobetaine in Comparative Concentrate A, (yielding Comparative Concentrate E) without modifying the hydrocarbon surfactant blend, foamability of premixes after oven aging was greatly deteriorated. In fact, the value of 4.6 for the aged fresh water premix was far below the minimum value required by the specification. However, if a short chain ($C_8$–$C_{10}$) alkyl ether sulfate blend was used in place of the aforementioned state-of-the-art hydrocarbon surfactant blend (i.e. Concentrate D), foam expansion in fresh water remained excellent (i.e., 8.6), even after oven aging. As higher foam expansion results in more efficient flame knockdown, more effective fire extinguishing properties can be achieved, especially after prolonged storage, when short chain alkyl ether sulfates are employed in aqueous film-forming foam concentrates containing fluorinated aminocarboxylate surfactants.

EXAMPLE 4

This example demonstrates the improvement in film formation and sealability on a low surface tension fuel (n-heptane) realized when a short chain ($C_8$–$C_{10}$) rather than longer chain (e.g. $C_{12}$) alkyl ether sulfate, such as conventionally used in the art, is employed in a formulation of this invention. Concentrates F and Comparative Concentrate G both contain the desirable beforementioned blend of fluorinated aminocarboxylate (I) and perfluorooctane sulfonate fluorochemical surfactants; however, Concentrate F employs a short chain (75% $C_8$, 25% $C_{10}$) alkyl ether sulfate blend, while Comparative Concentrate G contains commonly used lauryl ($C_{12}$) ether sulfate equal in amount to the short chain alkyl ether sulfate blend in Concentrate F. The film formation and sealability test used for comparative evaluation is described in the proposed U.S. Department of Defense Military Specification No. MIL-F-24385 Revision D, Section 4.7.7, and describes the generation of an aqueous film by the gentle application of 0.25 mL of premix solution down the thread of an inverted No. 8 flathead wood screw placed in the center of a 20 cm diameter glass petri dish containing 40 mL of n-heptane (>99% purity, surface tension =20.4 dynes/cm). Two minutes after applying the first drop of premix solution, a small flame is held over the n-heptane surface; for a good vapor seal, no sustained ignition shall result. Surface and interfacial tensions (vs. n-heptane) are measured with a duNouy tensiometer and the resulting spreading coefficient is calculated, according to Section 4.7.5 of this same government specification.

Test results following the above referenced procedure are summarized in Table V.

TABLE V

Spreading Coefficient and Film Sealability on n-Heptane

| | Concentrate F | | Concentrate G* | |
|---|---|---|---|---|
| | 3.0% Fresh Premix | 3.0% Sea Premix | 3.0% Fresh Premix | 3.0% Sea Premix |
| Surface tension (dynes/cm) | 16.5 | 17.2 | 17.7 | 18.8 |
| Interfacial tension (dynes/cm) vs. n-heptane | 3.3 | 2.9 | 2.5 | 2.2 |
| Spreading coefficient (dynes/cm) (Surf. tens. n-heptane = 20.4) | +0.6 | +0.3 | +0.2 | −0.6 |
| Film sealability, n-heptane | Pass | Pass | Fail | Fail |

*Comparative

Examination of Table V shows that premixes made from Concentrate F, employing the $C_8$–$C_{10}$ alkyl ether sulfate surfactant blend, exhibited an excellent vapor seal on the surface of the n-heptane by lowering interfacial tension slightly to produce a small but positive spreading coefficient. Premixes made from Comparative Concentrate G, employing the lauryl ($C_{12}$) ether sulfate, showed even lower interfacial tension values, which one skilled in the art would expect to improve film spread by increasing the spreading coefficient value. However, surface tensions with Concentrate G were markedly increased, indicating an interference with the surface tension function of the fluorochemical surfactants. This increase in surface tension for the sea water premix of Comparative Concentrate G to a value of 18.8 was sufficient to produce a negative spreading coefficient and, thus, no film spread on n-heptane. Though the fresh water premix of Concentrate G gave a slightly positive spreading coefficient vs. n-heptane, the film produced was very thin and sporadic, exhibiting no vapor sealing characteristics as shown by failing the seal test (believed to be caused by too low of an interfacial tension). Though small amounts of an alkyl ether sulfate with alkyl chain length greater than $C_{10}$ may be employed in formulations containing fluorinated aminocarboxylate (I) and perfluoroctane sulfonate surfactants, the use of such a longer chain alkyl ether sulfate in major proportions (required for foam boosting and sea water compatibilizing) is very detrimental to the aqueous film-forming properties of these formulations.

Applicants have also discovered an improved process for synthesizing the fluorinated aminocarboxylate, $C_6F_{13}SO_2N(C_2H_4COO^-)C_3H_6N^+(CH_3)_2H$, used in the preferred concentrates (Table I). The process employs the reaction of acrylic acid and fluoroaliphatic sulfonamidoamine under conditions which selectively directs addition to the sulfonamido nitrogen, which is not believed to have been employed heretofore in such synthesis. The process is as follows:

A mixture of dimethylaminopropylamine (12.2 g, 0.12 mole), triethylamine (8.1 g, 0.08 mole) and toluene (60 g) was first prepared at ambient temperature. To this mixture was added perfluorohexanesulfonyl fluoride (41.0 g, 0.10 mole) and the total mixture was then heated for 3 hours at 90° C. Hot deionized water (15 g) at a temperature of 95° C. was then added and the reaction mixture was vigorously stirred for 5 minutes while maintaining the mixture at a reaction temperature between about 85 to 90° C. At the end of this period, the stirring was stopped and the reaction mixture separated into two liquid phases. The dark aqueous bottom phase (20 g), which had formed containing extracted amine hydrofluoride by-product, was drained off. The temperature of the remaining toluene phase was slowly raised to 135° C. while distilling off toluene, residual water and amine under atmospheric pressure. The collected distilled overhead amounted to 59 g. The resulting brown liquid, consisting essentially of about 95 wt. % intermediate sulfonamidoamine, $C_6F_{13}SO_2N(H)C_3H_6N(CH_3)_2$, was cooled to 125° C., and phenothiazine (a polymerization inhibitor, 0.06 g, 1000 ppm), and acrylic acid (9.0 g, 0.125 mole) were added and the reaction was subsequently heated and maintained at 130°-135° C, for 10 hours, at which time nuclear magnetic resonance (NMR) spectrometry analysis indicated the reaction was complete. The NMR analysis revealed the formation of final product which contained less than 5 wt % of unreacted $C_6F_{13}SO_2N(H)C_3H_6N(CH_3)_2$. The mixture was cooled to 100° C. and residual toluene and acrylic acid were distilled off under reduced pressure (15 torr) at 95°-100° C. Butyl Carbitol TM (18.8 g) and deionized water (50.2 g) were added and the resulting mixture was stirred for 10 minutes until homogeneous to give a clear, light amber-colored solution (45.0% solids/15.0% butyl Carbitol/40.0% water). The resulting solution contained fluorinated aminocarboxylate (approximately 75% purity) which may be employed in the preferred formulations of the invention. Specifically, the resulting product contained the preferred fluorinated aminocarboxylate, namely $C_6F_{13}SO_2N(C_2H_4COO^-)C_3H_6N^+(CH_3)_2H$, at a purity of at least 50% by weight and typically at a purity between about 70% to 90% by weight. By-products contained in the product solution, resulting from the foregoing synthesis, are believed to be $C_6F_{13}SO_2N(H)C_3H_6N^+(CH_3)_2C_2H_4CO_2^-$ and $C_6F_{13}SO_2N(C_2H_4CO_2H)C_3H_6N^+(CH_3)_2C_2H_4CO_2^-$.

The above described process of synthesizing the preferred fluorinated aminocarboxylate, $C_6F_{13}SO_2N(C_2H_4COO^-)C_3H_6N^+)C_3H_6N^+(CH_3)_2H$, using acrylic acid as a reactant, has been found to be safer and far more economical than conventional alkylation synthesis which typically employ ring-opening reactions of lactones (e.g. propiolactone) or condensation reactions with chloropropionic or chloroacetic acids. Such reactive lactones are suspected carcinogens; displacement of chloride from chloropropionic acid or chloroacetic acid gives residual chloride ion by-product which can cause corrosion or pitting of stainless steel typically used in fire-fighting or other equipment. A conventional synthesis for fluorinated aminocarboxylate employing propiolactone reactant is disclosed in U.S. Pat. No. 3,661,776 (Fletcher) at column 3.

While the present invention has been described with respect to specific embodiments it should be appreciated that the invention is not intended to be limited to such embodiments. It should be appreciated that chemical species, other than the preferred species within a disclosed class of surfactants used in this invention, may be substituted for the preferred species without departing from the scope of the invention. Therefore, the present invention is not intended to be limited to the preferred embodiments.

What is claimed is:

1. An aqueous film-forming foamable solution comprising (a) fluoroaliphatic amphoteric surfactant, (b) fluoroaliphatic anionic surfactant, and (c) hydrocarbon surfactant comprising alkyl ether sulfate having an alkyl group of 6 to 10 carbon atoms.

2. The aqueous film-forming foamable solution of claim 1 wherein said solution upon dilution with water and aeration forms a foam.

3. The aqueous film-forming foamable solution of claim 1 wherein the fluoroaliphatic amphoteric surfactant (a) is represented by the formula:

$$R_fXNR^1A^-$$
$$\quad\;\; | $$
$$\quad R^2N^+(R)_3$$

where $R_f$ is a fluoroaliphatic group of 3 to 20 carbon atoms; X is selected from the group consisting of CO and $SO_2$; $R^1$ and $R^2$ are divalent linking groups of from 1 to 12 carbon atoms selected from the group consisting of alkylene, arylene, aralkylene, and alkarylene; each R represents like or different groups selected from the group consisting of hydrogen, aryl, and alkyl groups of 1 to 18 carbon atoms; and $A^-$ is an anion selected from the group consisting of $—CO_2^-$, $—SO_2^-$, $—SO_3^-$, $—OSO_3^-$, and $—OP(OH)O^-$; wherein the fluoroaliphatic anionic surfactant (b) comprises a fluoroaliphatic compound having at least one said fluoroaliphatic group $R_f$ and an anionic group.

4. The aqueous film-forming foamable solution of claim 1 wherein the fluoroaliphatic amphoteric surfactant (a) is a fluorinated aminocarboxylate represented by the formula:

$$R_fXNR^1COO^-$$
$$\quad\;\; | $$
$$\quad R^2N^+(R)_2H$$

wherein, $R_f$ is a fluoroaliphatic group of 3 to 20 carbon atoms, X is selected from the group consisting of CO and $SO_2$; $R^1$ and $R^2$ are divalent linking groups of from 1 to 12 carbon atoms selected from the group consisting of alkylene, arylene, aralkylene, and alkarylene; each R represents like or different groups selected from the group consisting of hydrogen and alkyl groups of 1 to 12 carbon atoms, and wherein the fluoroaliphatic anionic surfactant (b) comprises a fluoroaliphatic compound having at least one said fluoroaliphatic group $R_f$ and an anionic group.

5. The aqueous film-forming foamable solution of claim 3 wherein the fluoroaliphatic anionic surfactant (b), is represented by the formula:

$$R_fSO_3M$$

where $R_f$ is a perfluoroaliphatic group having the formula $C_nF_{2n+1}$ where n is 4 to 10, and M is a metal or ammonium ion.

6. The aqueous film-forming foamable solution of claim 1 wherein the hydrocarbon surfactant comprising an alkyl ether sulfate (c) is represented by the formula:

$$C_nH_{2n+1}O(C_2H_4O)_mSO_3M$$

wherein:

n is an integer between 6 and 10 and m is a value between 1 to 10, and M is a metal or ammonium ion.

7. The aqueous film-forming foamable solution of claim 4 wherein $R_f$ of the fluorinated aminocarboxylate comprises a perfluoroaliphatic group of 4 to 10 carbon atoms.

8. The aqueous film-forming foamable solution of claim 1 wherein the fluoroaliphatic anionic surfactant comprises a perfluoroalkane sulfonate wherein the perfluoroalkane group contains from 4 to 10 carbon atoms.

9. The aqueous film forming foamable concentrate of claim 4 wherein the fluorinated aminocarboxylate comprises a compound having the following formula:

$$C_6F_{13}SO_2\overset{\overset{\displaystyle C_2H_4COO^-}{|}}{N}C_3H_6N^+(CH_3)_2H$$

10. The aqueous film-forming foamable solution of claim 8 wherein the perfluoroalkane sulfonate comprises a perfluorooctane sulfonate compound represented by the formula:

$$C_8F_{17}SO_3M$$

wherein M is a metal or ammonium ion.

11. A method of using an aqueous film-forming foamable concentrate for extinguishing flammable liquid fires comprising:

i. mixing said concentrate with water passing through a fire extinguishing hose in order to form a premixture, and ii. aerating the premixture as it passes through said hose or a nozzle attached thereto to produce an air foam, and iii. applying said air foam to a flammable liquid, said concentrate comprising an aqueous solution of a. fluoroaliphatic amphoteric surfactant, b. fluoroaliphatic anionic surfactant, and c. hydrocarbon surfactant comprising an alkyl ether sulfate having an alkyl group of 6 to 10 carbon atoms.

12. The method of claim 11 wherein the fluoroaliphatic amphoteric surfactant (a) is represented by the formula:

$$R_fX\overset{\overset{\displaystyle R^1A^-}{|}}{N}R^2N^+(R)_3$$

where $R_f$ is a fluoroaliphatic group of 3 to 20 carbon atoms; X is selected from the group consisting of CO and $SO_2$; $R^1$ and $R^2$ are divalent linking groups of from 1 to 12 carbon atoms selected from the group consisting of alkylene, arylene, aralkylene, and alkarylene; each R represents like or different groups selected from the group consisting of hydrogen, aryl and alkyl groups, said aryl and alkyl groups of 1 to 18 carbon atoms; and $A^-$ is a functional group selected from the group consisting of $—CO_2^-$, $—SO_2^-$, $—SO_3^-$, $—OSO_3^-$, and $—OP(OH)O^-$; and wherein the fluoroaliphatic anionic surfactant (b) comprises a fluoroaliphatic compound having at least one said fluoroaliphatic group $R_f$ and anionic group.

13. The method of claim 11 wherein the fluoroaliphatic amphoteric surfactant (a) is a fluorinated aminocarboxylate represented by the formula:

$$R_fX\overset{\overset{\displaystyle R^1CO_2^-}{|}}{N}R^2N^+(R)_2H$$

wherein, $R_f$ is a fluoroaliphatic group of 3 to 20 carbon atoms, X is selected from the group consisting of CO and $SO_2$; $R^1$ and $R^2$ are divalent linking groups of from 1 to 12 carbon atoms selected from the group consisting of alkylene, arylene, aralkylene, and alkarylene; and each R represents like or different groups selected from the group consisting of hydrogen and alkyl groups of 1 to 12 carbon atoms; and wherein the fluoroaliphatic anionic surfactant (b) comprises a fluoroaliphatic compound having at least one said fluoroaliphatic group $R_f$ and an anionic group.

14. The method of claim 11 wherein the fluoroaliphatic anionic surfactant (b) is represented by the formula:

$$R_fSO_3M$$

where $R_f$ is a perfluoroaliphatic radical having the formula $C_nF_{2n+1}$ where n is 4 to 10, and M is a metal or ammonium ion.

15. The method of claim 11 wherein the hydrocarbon surfactant comprising an alkyl ether sulfate (c) represented by the formula:

$$C_nH_{2n+1}O(C_2H_4O)_mSO_3M$$

wherein n is an integer between 6 and 10 and m is a value between 1 to 10, and M is a metal or ammonium ion.

16. The method of claim 13 wherein $R_f$ of the fluorinated aminocarboxylate comprises a perfluoroaliphatic group of 4 to 10 carbon atoms.

17. The method of claim 13 wherein the fluorinated aminocarboxylate comprises a compound having the following formula:

$$C_6F_{13}SO_2\overset{\overset{\displaystyle C_2H_4COO^-}{|}}{N}C_3H_6N^+(CH_3)_2H$$

18. The method of claim 14 wherein the fluoroaliphatic anionic surfactant (b) comprises a perfluorooctane sulfonate compound represented by the formula:

$$C_8F_{17}SO_3M$$

where M is a metal or ammonium ion.

19. The aqueous film-forming foamable solution of claim 1 wherein the fluoroaliphatic amphoteric surfactant (a) is represented by the formula:

$$R_fX\overset{\overset{\displaystyle R^1A^-}{|}}{N}R^2N^+(R)_3$$

where $R_f$ is a fluoroaliphatic group of 3 to 20 carbon atoms; X is selected from the group consisting of CO and $SO_2$; $R^1$ and $R^2$ are divalent linking groups of from 1 to 12 carbon atoms selected from the group consisting of alkylene, arylene, aralkylene, and alkarylene; two of the R groups taken together with the N atom to which they are attached forming a heterocyclic ring, and third R selected from the group consisting of hydrogen, aryl and alkyl groups of 1 to 18 carbon atoms; and $A^-$ is an anion selected from the group consisting of $—CO_2^-$, $—SO_2^-$, $—SO_3^-$, $—OSO_3^-$, and $—OP(OH)O^-$; wherein the fluoroaliphatic anionic surfactant (b) comprises a fluoroaliphatic compound having at least one said fluoroaliphatic group $R_f$ and an anionic group.

* * * * *